US005338236A

United States Patent [19]

Dunham et al.

[11] Patent Number: 5,338,236

[45] Date of Patent: Aug. 16, 1994

[54] LATCH MECHANISM FOR OUTBOARD MOTOR COWL ASSEMBLY

[75] Inventors: William D. Dunham, Waukegan; Jerry A. Hladilek, Kenosha; Steven R. McNeill; John A. Pierman, both of Waukegan, all of Ill.; Charles T. Rogan, Kenosha, Wis.; Robert L. Turk, Waukegan, Ill.

[73] Assignee: Outboard Marine Corporation, Waukegan, Ill.

[21] Appl. No.: 55,982

[22] Filed: Apr. 29, 1993

[51] Int. Cl.[5] ..... B63H 21/26

[52] U.S. Cl. ..... 440/77

[58] Field of Search ..... 440/77; 292/DIG. 31, 292/103, 204, 336.3, 347

[56] References Cited

U.S. PATENT DOCUMENTS

| | | | |
|---|---|---|---|
| 2,164,150 | 6/1939 | Brewster | 292/DIG. 31 X |
| 3,436,860 | 4/1969 | James | 292/103 X |
| 4,510,779 | 4/1985 | Ahad | 292/DIG. 31 X |
| 4,661,076 | 4/1987 | Iwai | 440/77 |
| 4,698,037 | 10/1987 | Watanabe et al. | 440/78 |
| 4,708,673 | 11/1987 | Dunham et al. | 440/77 |
| 4,844,031 | 7/1989 | Boda et al. | 123/195 |
| 4,871,333 | 10/1989 | Curtis et al. | 440/77 |
| 4,875,883 | 10/1989 | Slattery | 440/77 |
| 4,932,909 | 6/1990 | Curtis et al. | 440/77 |
| 4,971,587 | 11/1990 | Uchida et al. | 440/77 |
| 5,025,763 | 6/1991 | Watanabe | 123/198 |
| 5,052,353 | 10/1991 | Dunham et al. | 123/195 |
| 5,120,248 | 6/1992 | Daleiden et al. | 440/77 |
| 5,195,483 | 3/1993 | Ishida | 123/198 |

*Primary Examiner*—Sherman Basinger

*Attorney, Agent, or Firm*—Michael, Best & Friedrich

[57] ABSTRACT

An outboard motor comprising a propulsion unit including a propeller shaft and a power head drivingly connected to the propeller shaft, and a cowling surrounding the power head, the cowling comprising a first cover member including an outer surface having therein a recess, a second cover member mating with the first member, and a selectively engageable latch mechanism for securing the second member to the first member, the latch mechanism including a latch handle which is supported by the first member, which is movable in a first direction between a flush position wherein the latch handle is in the recess and is flush with the remainder of the outer surface and a non-flush position wherein the latch handle extends from the recess, and which is movable in a second direction to engage and disengage the latch mechanism.

19 Claims, 3 Drawing Sheets

LATCH MECHANISM FOR OUTBOARD MOTOR COWL ASSEMBLY

BACKGROUND OF THE INVENTION

The invention relates to outboard motors, and more particularly to latch mechanisms for outboard motor cowl assemblies.

A conventional outboard motor cowl assembly includes a pan-like lower cover member and a dome-like upper cover member. A typical latch mechanism includes a pin extending horizontally from the inside of the upper cover member. A shaft extends through the lower cover member and is pivotable about its longitudinal axis relative to the lower cover member. A hook is fixed to the inner end of the shaft. The outer end of the shaft has thereon a latch handle that allows an operator to pivot the hook between a latched position wherein the hook engages the pin and an unlatched position wherein the hook is disengaged from the pin. Such an arrangement is disclosed in U.S. Pat. No. 5,052,353.

Attention is also directed to U.S. Pat. No. 4,871,333, which discloses a latch mechanism with a handle pivotable about a vertical axis. The handle is flush with the outer surface of the cowl assembly when the handle is in its latched position.

SUMMARY OF THE INVENTION

The invention provides an outboard motor comprising a propulsion unit including a propeller shaft and a power head drivingly connected to the propeller shaft, and a cowling surrounding the power head, the cowling comprising a first cover member including an outer surface having therein a recess, a second cover member mating with the first member, and a selectively engageable latch mechanism for securing the second member to the first member, the latch mechanism including a latch handle which is supported by the first member, which is movable in a first direction between a flush position wherein the latch handle is in the recess and is flush with the reminder of the outer surface and a non-flush position wherein the latch handle extends from the recess, and which is movable in a second direction to engage and disengage the latch mechanism.

The invention also provides an outboard motor comprising a propulsion unit including a propeller shaft and a power head drivingly connected to the propeller shaft, and a cowling surrounding the power head, the cowling comprising a first cover member including an outer surface having therein a recess, a second cover member mating with the first member, and a selectively engageable latch mechanism for securing the second member to the first member, the latch mechanism including a latch handle which is supported by the first member, which is movable in a first direction between a flush position wherein the latch handle is in the recess and is flush with the reminder of the outer surface and a non-flush position wherein the latch handle extends from the recess, and a detent mechanism for releasably securing the handle in the flush position, the detent mechanism comprising a detent on one of the first member and the latch handle, and a socket on the other of the first member and the latch handle, the detent engaging the socket to releasably secure the latch handle in the flush position.

A principal feature of the invention is the provision of a latch mechanism with a handle that is movable in one direction between a flush position and a non-flush position, and that is movable in a second direction between a latched position and an unlatched position. This arrangement permits the handle to be flush with the outer surface of the cowling when the latch mechanism is engaged, and at the same time permits the latch mechanism to be in a conventional location (such as the location of U.S. Pat. No. 5,052,353), rather than in the unusual location disclosed by U.S. Pat. No. 4,871,333. The flush handle improves appearance and eliminates a protrusion that can snag such things as fishing lines. The dual action operation (movement in the first direction and in the second direction) of the latch mechanism helps avoid accidental opening of the latch mechanism and helps prevent the operator from mistakenly thinking the latch mechanism is engaged.

Another principal feature of the invention is the provision of the detent arrangement for securing the handle in the latched position. This lets the operator know that the latch mechanism is fully engaged and also helps prevent accidental opening of the latch mechanism.

Other features and advantages of the invention will become apparent to those skilled in the art upon review of the following detailed description, claims and drawings.

Figure 1:
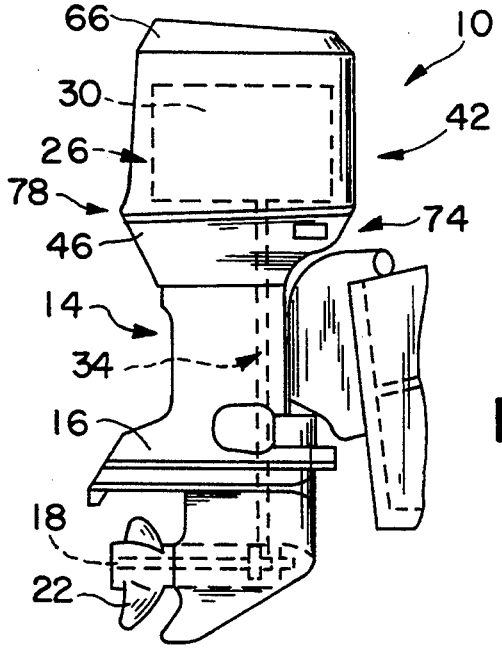
FIG. 1 is a side elevational view of an outboard motor embodying the invention.
Figure 2:
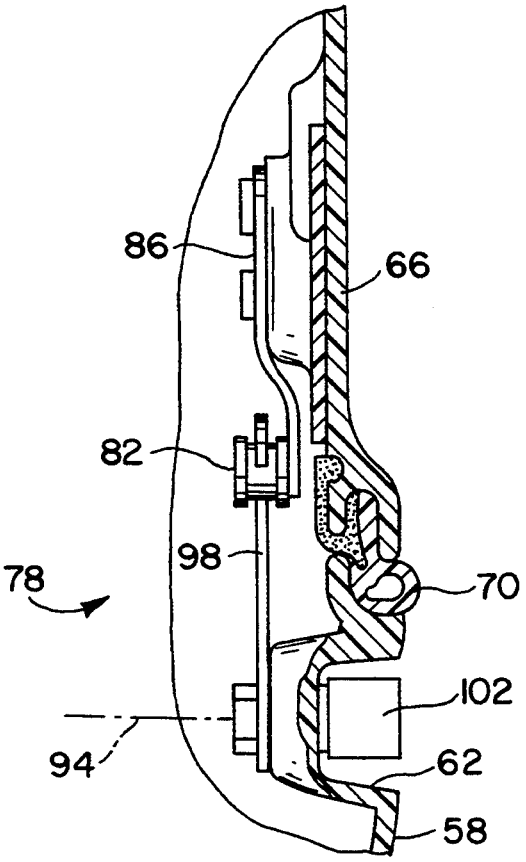
FIG. 2 is a vertical cross-sectional view of a portion of the cowl assembly of the outboard motor.
Figure 3:
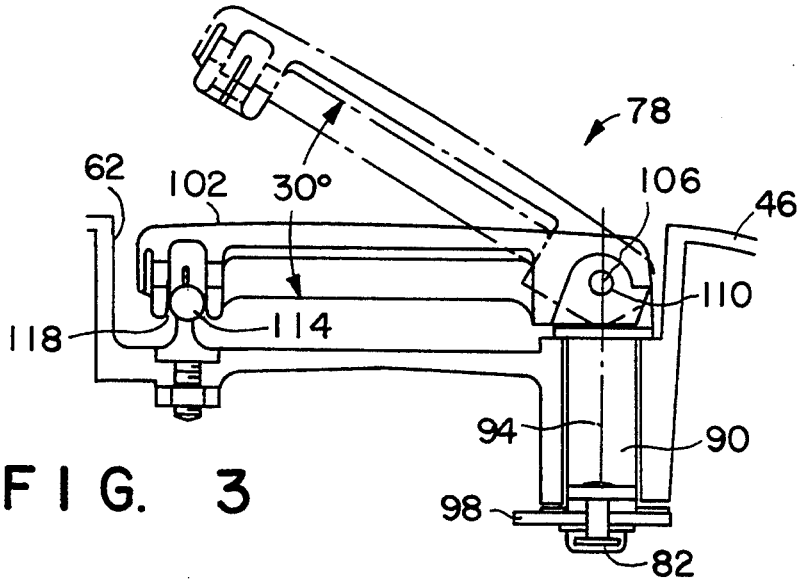
FIG. 3 is a horizontal cross-sectional view of the latch mechanism shown in FIG. 2.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An outboard motor 10 embodying the invention is illustrated in the drawings. The outboard motor 10 comprises (see FIG. 1) a propulsion unit 14 having a lower unit 16 and a propeller shaft 18 which is rotatably supported by the lower unit 16 and which supports a propeller 22. The propulsion unit 14 also includes a power head 26 including an internal combustion engine 30 supported by the lower unit 16 and drivingly connected to the propeller shaft 18 by a conventional drive train 34.

Figure 4:
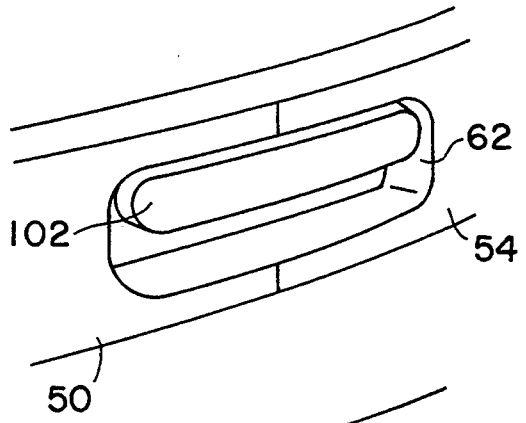
FIG. 4 is a perspective view of the latch handle in its flush position.

The outboard motor 10 further comprises a cowl assembly 42 surrounding the engine 30. Except as described below, the cowl assembly 42 can be identical to the assembly disclosed in U.S. Pat. No. 5,052,353, which is incorporated herein by reference. The cowl assembly 42 includes a pan-like lower cover member 46 having an endless upper end. The lower cover member 46 is preferably formed of (see FIG. 4) starboard and port halves 50 and 54, respectively, which are substantially mirror images of each other. The halves 50 and 54 of the lower cover member 46 can be, for example, mounted on the lower unit 16 in the manner described in U.S. Pat. No. 4,708,673, which is incorporated herein by reference. The lower cover member 46 has (see FIGS. 2–6) an outer surface 58 having therein a recess 62, the reason for which is explained below.

The cowl assembly 42 also includes (see FIG. 1) a dome-shaped upper cover member 66. The upper cover member 66 has an endless lower end. The cowl assembly 42 further includes (see FIG. 2) an endless seal 70 between the upper end of the lower cover member 46 and the lower end of the upper cover member 66. The seal 70 can also be the same as disclosed in Pat. No. 5,052,353.

The cowl assembly 42 also includes a latch arrangement for releasably securing the upper cover member 66 to the lower cover member 46 and for compressing the seal 70 between the upper end of the lower cover member 46 and the lower end of the upper cover member 66. In the preferred embodiment, the latch arrangement includes (see FIG. 1) a front latch mechanism 74 located in the front of the cowl assembly 42 and a rear latch mechanism 78 located in the rear of the cowl assembly 42. The latch mechanisms 74 and 78 are substantially identical, and only the rear latch mechanism 78 will be described in detail.

The latch mechanism 78 includes (see FIGS. 2 and 3) a latch pin 82 extending generally horizontally inward from the inner surface of the upper cover member 66. Any suitable arrangement can be used to mount the pin 82 on the upper cover member 66. In the illustrated construction, the pin 82 is supported by a bracket 86 bonded to the inner surface of the upper cover member 66. This construction is described in detail in Pat. No. 5,052,353 and will not be further described herein.

The latch mechanism 78 also includes (see FIG. 3) a latch shaft 90 pivotably supported by the portion of the lower cover member 46 having therein the recess 62. The shaft 90 has a longitudinal axis 94 and is supported for pivotal movement about the longitudinal axis 94. The shaft 90 includes an inner end inside the lower cover member 46 and an outer end outside the lower cover member 46.

The latch mechanism 78 also includes (see FIGS. 2 and 3) a latch hook 98 fixed to the inner end of the shaft 90 for common pivotal movement therewith. The hook 98 is movable, by pivoting the shaft 90 about its axis 94, between a latched position (FIGS. 2 and 3) wherein the hook 98 engages the pin 82 and an unlatched position (not shown) wherein the hook 98 is disengaged from the pin 82. Particularly, movement of the hook 98 from the unlatched position to the latched position causes camming and engagement of the pin 82 by the hook 98 and thereby releasably secures the upper cover member 66 to the lower cover member 46 and compresses the seal 70 between the cover members.

The latch mechanism 78 also includes (see FIGS. 2–6) a latch handle 102 connected to the outer end of the shaft 90 for common pivotal movement therewith about the shaft axis 94 and for pivotal movement relative thereto about an axis 106 (see FIG. 3) transverse to the shaft axis 94. The axis 106 is preferably vertical. Specifically, a pivot pin 110 pivotally connects the latch handle 102 to the shaft 90. The handle 102 is movable in a first direction (i.e., is pivotable about the axis 106) between a flush position (shown in solid lines in FIG. 3 and in FIG. 4) wherein the latch handle 102 is in the recess 62 and is flush with the reminder of the outer surface 58 and a non-flush position (shown in FIGS. 5 and 6 and in phantom in FIG. 3) wherein the latch handle 102 extends from the recess 62. The handle 102 is also movable in a second direction (i.e., is pivotable about the shaft axis 94) to move the hook 98 between its latched (FIGS. 2–4) and unlatched (FIG. 6) positions and to thereby engage and disengage the latch mechanism 78.

The latch mechanism 78 also includes (see FIG. 3) a detent or projection or ball 114 extending outwardly from the lower cover member 46 in the recess 62. The handle 102 includes a detent receiving recess or socket 118. The detent 114 snaps into the socket 118 to releasably secure the handle 102 in its flush position.

Figure 5:
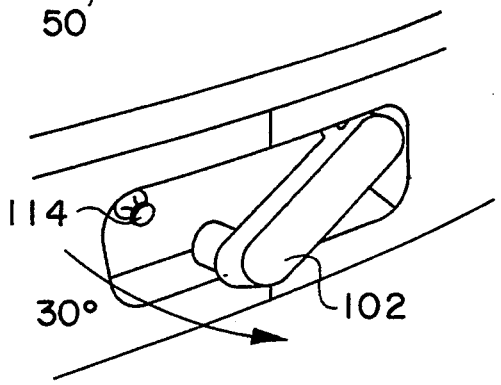
FIG. 5 is a perspective view of the latch handle in its non-flush position with the latch mechanism engaged.
Figure 6:
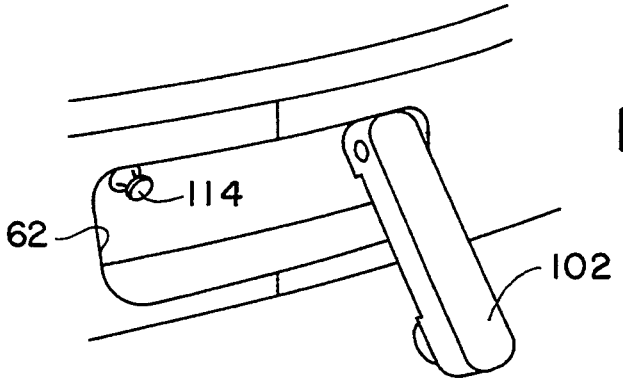
FIG. 6 is a perspective view of the latch handle in its non-flush position with the latch mechanism disengaged.
Figure 7:
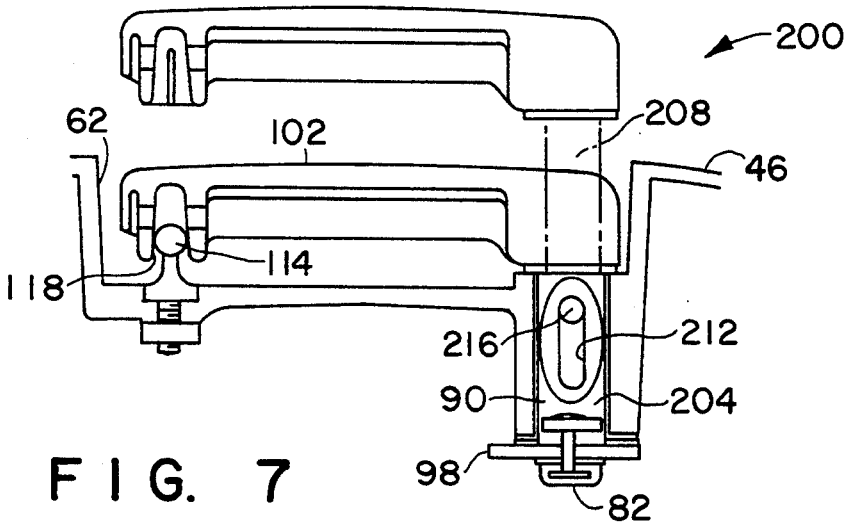
FIG. 7 is a horizontal cross-sectional view of an alternative latch mechanism.
Figure 8:
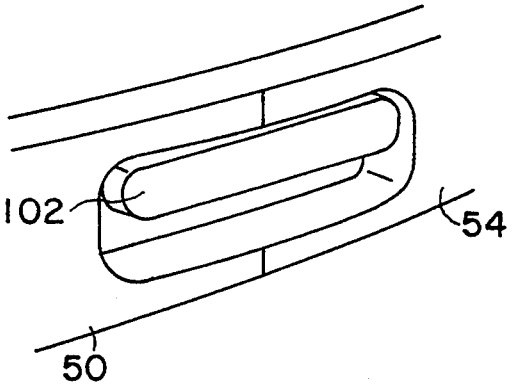
FIG. 8 is a perspective view of the latch handle of FIG. 7 in its flush position.
Figure 9:
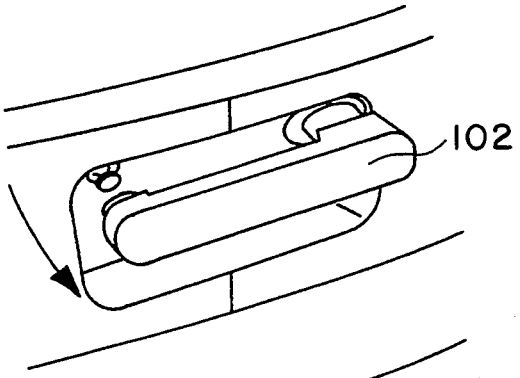
FIG. 9 is a perspective view of the latch handle of FIG. 7 in its non-flush position with the latch mechanism engaged.
Figure 10:
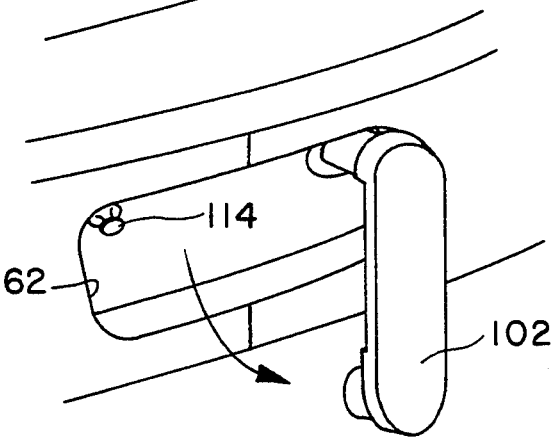
FIG. 10 is a perspective view of the latch handle of FIG. 7 in its non-flush position with the latch mechanism disengaged.

In operation, the latch mechanism 78 is disengaged by pivoting the latch handle 102 to remove the detent 114 from the socket 118 and to move the handle 102 from its flush position to its non-flush position (see FIG. 5). The latch handle 102 is then pivoted about the shaft axis 94 (counterclockwise in FIG. 5) to move the hook 98 from its latched position to its unlatched position. It should be noted that the outer surface of the lower cover member prevents pivotal movement of the handle 102 about the shaft axis 94 (i.e., the hook 98 cannot be moved to its unlatched position) until the handle 102 is moved to its non-flush position. This substantially prevents accidental disengagement of the latch mechanism by bumping the handle 102.

To re-engage the latch mechanism 78, the handle 102 is pivoted about the shaft axis 94 (clockwise in FIG. 6) to move the hook 98 from its unlatched position to its latched position. This causes the hook 98 to engage the pin 82 and secure the cover members together. The handle 102 is then moved to its flush position so that the socket 118 houses the detent 114 and releasably secures the handle 102 in its flush position. It should be understood that the outer surface 58 of the lower cover member 46 prevents movement of the handle 102 to its flush position unless the hook 98 is in its latched position. In other words, the handle 102 is movable to the flush position only when the latch mechanism 78 is engaged. This substantially prevents the operator from mistakenly thinking the latch mechanism 78 is engaged.

An alternative latch mechanism 200 is shown in FIGS. 7–10. Except as described below, the mechanism 200 is identical to the mechanism 78, and common elements have been given the same reference numerals.

In the mechanism 200, the latch shaft 90 includes (see FIG. 7) an inner member 204 having thereon the latch hook 98, and an outer member 208 having thereon the latch handle 102. The handle 102 does not pivot relative to the outer member 208. Instead, the outer member 208 telescopes relative to the inner member 204. In other words, the outer shaft member 208 is movable translationally along the shaft axis 94. The shaft members 204 and 208 are also connected such that pivotal movement of the outer member 208 about the axis 94 causes pivotal movement of the inner member 204 about the axis 94. Preferably, the outer member 208 has therein a slot 212 which slidably receives a pin 216 extending from the inner member 204. The pin 216 engages the opposite ends of the slot 212 and thereby serves as a stop which limits the telescoping action of the inner and outer shaft members.

In operation, the latch handle 102 of the latch mechanism 200 is moved from its flush position (FIG. 8) to its non-flush position (FIG. 9) by moving the handle 102 and the connected outer telescoping member 208 translationally and outwardly along the shaft axis 94. Only then can the latch handle 102 pivot about the shaft axis 94 (counterclockwise in FIG. 9) to disengage the hook 98 from the pin 82 and release the upper cover member 66 from the lower cover member 46. The latch mechanism 200 is re-engaged by pivoting the handle 102 (clockwise in FIG. 10) to move the hook 98 to its latched position. The handle 102 is then pushed inwardly along the shaft axis 94 to the flush position. The detent 114 and socket 118 secure the handle 102 in its flush position.

Various features of the invention are set forth in the following claims.

We claim:

1. An outboard motor comprising a propulsion unit including a propeller shaft and a power head drivingly connected to said propeller shaft, and a cowling surrounding said power head, said cowling comprising a first cover member including an outer surface having therein a recess, a second cover member mating with said first member, and a selectively engageable latch mechanism for securing said second member to said first member, said latch mechanism including a latch handle which is supported by said first member, which is movable between a flush position wherein said latch handle is in said recess and is flush with the remainder of said outer surface and a non-flush position wherein said latch handle extends from said recess, which, when in said non-flush position, is pivotally movable about a horizontal axis to engage and disengage said latch mechanism, and which is movable in another direction between said flush position and said non-flush position.

2. The outboard motor according to claim 1 wherein said latch mechanism further includes a latch pin supported by said second member, and a latch hook which is connected to said latch handle, and which is movable about said horizontal axis between a latched position wherein said hook engages said pin and an unlatched position wherein said hook is disengaged from said pin, and wherein movement of said handle about said horizontal axis moves said hook about said horizontal axis between said latched and unlatched positions.

3. The outboard motor according to claim 2 wherein said latch mechanism further includes a latch shaft connecting said latch handle to said hook.

4. The outboard motor according to claim 3 wherein movement of said latch handle in said other direction comprises pivotal movement about a second axis transverse to said horizontal axis.

5. The outboard motor according to claim 4 wherein pivotal movement of said shaft about said horizontal axis causes movement of said hook between said latched and unlatched positions, and wherein pivotal movement of said handle about said horizontal axis causes pivotal movement of said shaft about said horizontal axis.

6. The outboard motor according to claim 3 wherein movement of said latch handle between said flush and non-flush positions comprises translational movement along said horizontal axis.

7. The outboard motor according to claim 6 wherein pivotal movement of said shaft about said horizontal axis causes movement of said hook between said latched and unlatched positions, and wherein pivotal movement of said handle about said horizontal axis causes pivotal movement of said shaft about said horizontal axis.

8. The outboard motor according to claim 7 wherein said latch shaft comprises inner and outer telescoping members, said outer member being connected to said latch handle and said inner member begin connected to said latch hook such that said outer member is movable along said horizontal axis relative to said inner member, and such that pivotal movement of said outer member about said horizontal axis causes pivotal movement of said inner member about said horizontal axis.

9. The outboard motor according to claim 1 wherein said latch mechanism further comprises a detent on one of said first member and said latch handle, and a socket on the other of said first member and said latch handle, and wherein said detent engages said socket to releasably secure said latch handle in said flush position.

10. The outboard motor according to claim 1 wherein said handle is movable to said flush position only when said latch mechanism is engaged.

11. The outboard motor according to claim 1 wherein said handle is movable about said horizontal axis to disengage said latch mechanism only when said handle is in said non-flush position.

12. An outboard motor comprising a propulsion unit including a propeller shaft and a power head drivingly connected to said propeller shaft, and a cowling surrounding said power head, said cowling comprising a first cover member including an outer surface having therein a recess, a second cover member mating with said first member, and a selectively engageable latch mechanism for securing said second member to said first member, said latch mechanism including a latch handle which is supported by said first member, and which is movable between a flush position wherein said latch handle is in said recess and is flush with the reminder of said outer surface and a non-flush position wherein said latch handle extends from said recess, and a detent mechanism for releasably securing said handle in said flush position, said detent mechanism comprising a detent on one of said first member and said latch handle, and a socket on the other of said first member and said latch handle, said detent engaging said socket to releasably secure said latch handle in said flush position.

13. An outboard motor comprising a propulsion unit including a propeller shaft and a power head drivingly connected to said propeller shaft, and a cowling surrounding said power head, said cowling comprising a first cover including an outer surface having therein a recess, a second cover mating with said first cover, and a latch mechanism for securing said second cover to said first cover, said latch mechanism including a latch pin supported by said second cover, a hook pivotally movable about a horizontal axis between a latched position wherein said hook engages said pin and an unlatched position wherein said hook is disengaged from said pin, a shaft which is supported by said first cover, which extends along said horizontal axis, and which is connected to said hook such that pivotal movement of said shaft about said axis moves said hook between said latched and unlatched positions, a latch handle which is connected to said shaft such that pivotal movement of said handle about said horizontal axis moves said hook between said latched position and said unlatched position, and which is movable, in a direction other than pivotally about said axis, between a flush position wherein said latch handle is in said recess and is flush with said outer surface and a non-flush position wherein said latch handle extends from said recess, and a detent mechanism for releasably securing said latch handle in said flush position.

14. The outboard motor according to claim 13 wherein movement of said latch handle in said other direction comprises pivotal movement about an axis transverse to said horizontal axis.

15. The outboard motor according to claim 13 wherein movement of said latch handle in said direction comprises translational movement along said horizontal axis.

16. The outboard motor according to claim 15 wherein said shaft comprises inner and outer telescoping members, said outer member being connected to said latch handle and said inner member being connected to said hook such that said outer member is movable along said horizontal axis relative to said inner member, and such that pivotal movement of said outer member about said horizontal axis causes pivotal movement of said inner member about said horizontal axis.

17. The outboard motor according to claim 13 wherein said detent mechanism includes a detent on one of said first cover and said latch handle, and a socket on the other of said first cover and said latch handle, and wherein said detent engages said socket to releasably secure said latch handle in said flush position.

18. The outboard motor according to claim 13 wherein said handle is movable to said flush position only when said hook is in said latched position.

19. The outboard motor according to claim 13 wherein said handle is movable so as to move said hook to said unlatched position only when said handle is in said non-flush position.

* * * * *